US005447309A

United States Patent [19]

Vincent

[11] Patent Number: 5,447,309

[45] Date of Patent: Sep. 5, 1995

[54] GOLF CLUB HEAD

[75] Inventor: Benoît Vincent, Annecy le Vieux, France

[73] Assignee: Taylor Made Golf Company, Inc., Carlsbad, Calif.

[21] Appl. No.: 73,522

[22] Filed: Jun. 9, 1993

[30] Foreign Application Priority Data

Jun. 12, 1992 [FR] France ..... 92 07381

[51] Int. Cl.[6] ..... A63B 53/04

[52] U.S. Cl. ..... 273/169; 273/167 F; 273/167 H; 273/171

[58] Field of Search ..... 273/167 R, 167 F, 167 H, 273/169, 170, 171, 172, 173, 174, 193 R, 194 R, 194 A, 194 B, DIG. 8, DIG. 23, 77 R, 78

[56] References Cited

U.S. PATENT DOCUMENTS

| | | | |
|---|---|---|---|
| 2,056,335 | 10/1936 | Wettlaufer | 273/171 |
| 2,214,356 | 9/1940 | Wettlaufer | 273/171 |
| 3,692,306 | 9/1972 | Glover | 273/171 |
| 3,941,390 | 3/1976 | Hussey | 273/167 F |
| 4,326,716 | 4/1982 | LaCoste | 273/DIG. 8 |
| 4,438,931 | 3/1984 | Motomiya | 273/167 H |
| 4,471,961 | 9/1984 | Masghati et al. | 273/175 |
| 4,811,949 | 3/1989 | Kobayashi | 273/171 |
| 4,867,458 | 9/1989 | Sumikawa | 273/171 |
| 4,869,507 | 9/1989 | Sahm | 273/171 |
| 5,058,895 | 10/1991 | Igarashi | 273/167 F |
| 5,078,400 | 1/1992 | Desbiolles et al. | 273/167 F |
| 5,120,062 | 6/1992 | Scheie et al. | 273/167 F |
| 5,141,230 | 8/1992 | Antonious | 273/167 H |

FOREIGN PATENT DOCUMENTS

| | | | |
|---|---|---|---|
| 211781 | 12/1957 | Australia | 273/169 |
| 1202993 | 4/1986 | Canada . | |
| 2048281 | 2/1992 | Canada . | |
| 0470488 | 2/1992 | European Pat. Off. . | |
| 440379 | 1/1936 | United Kingdom . | |
| 2126906 | 4/1984 | United Kingdom . | |
| 2202451 | 9/1988 | United Kingdom . | |
| WO88/01524 | 3/1988 | WIPO . | |
| WO88/01525 | 3/1988 | WIPO . | |

*Primary Examiner*—Sebastiano Passaniti
*Attorney, Agent, or Firm*—Sandler, Greenblum & Bernstein

[57] ABSTRACT

The head of a golf club, preferably of the "wood" type, wherein the orthogonal reference passing through the center of gravity of the club head and formed by three axes about which the inertia is maximum, is such that the first two axes are located in a plane inclined with respect to the plane of the ground when the head rests on the ground, forming with the plane of the ground, a dihedron having an internal angle comprised between 20 and 60 degrees and/or wherein the axis forms with the vertical plane of the shot, an angle of between 20 and 60 degrees.

44 Claims, 9 Drawing Sheets

FIG. 5
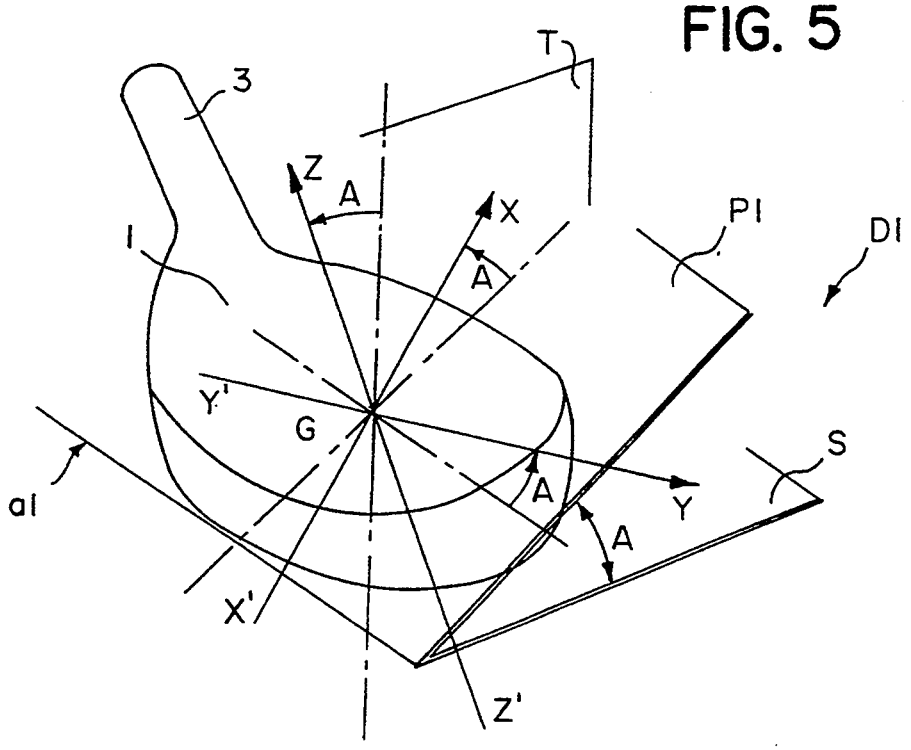
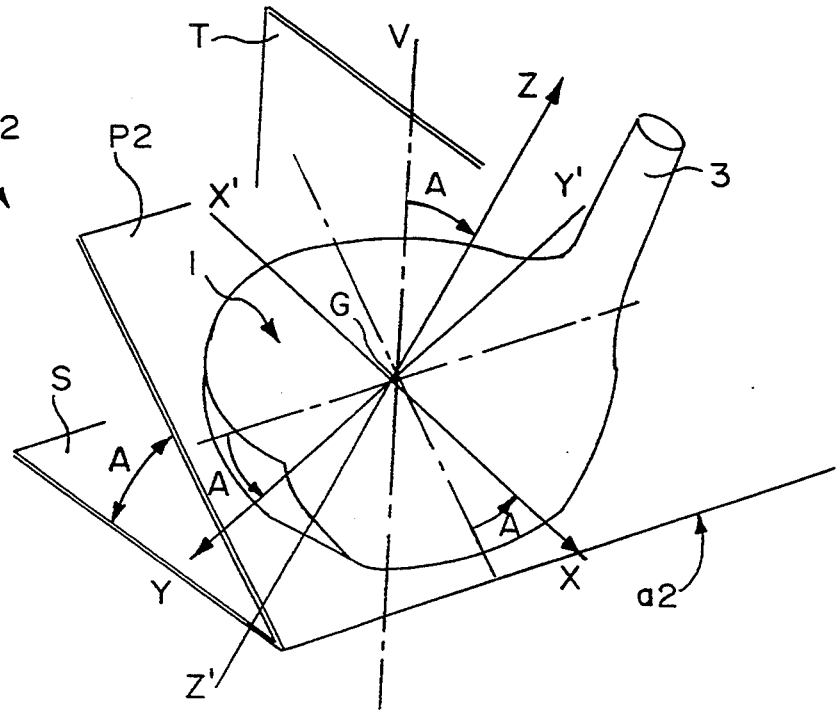
FIG. 6

FIG. 15
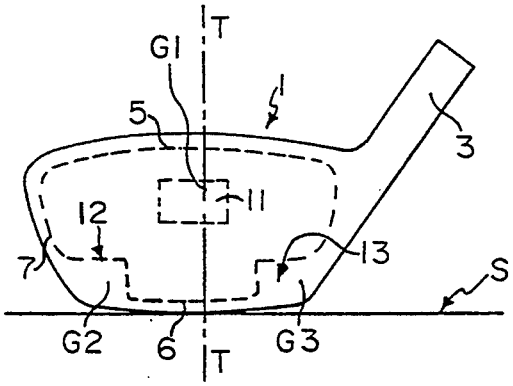
FIG. 16
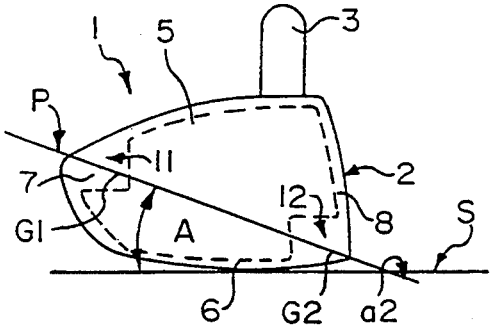
FIG. 17
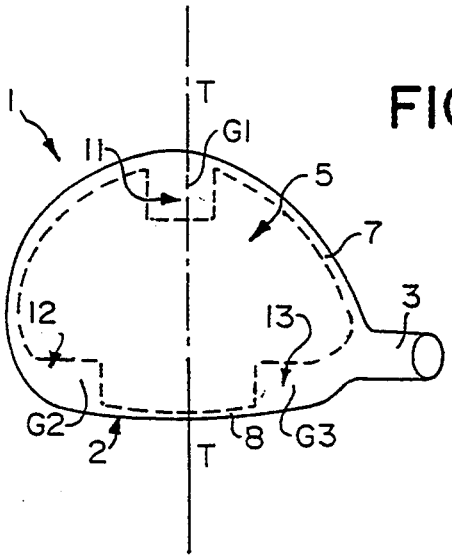
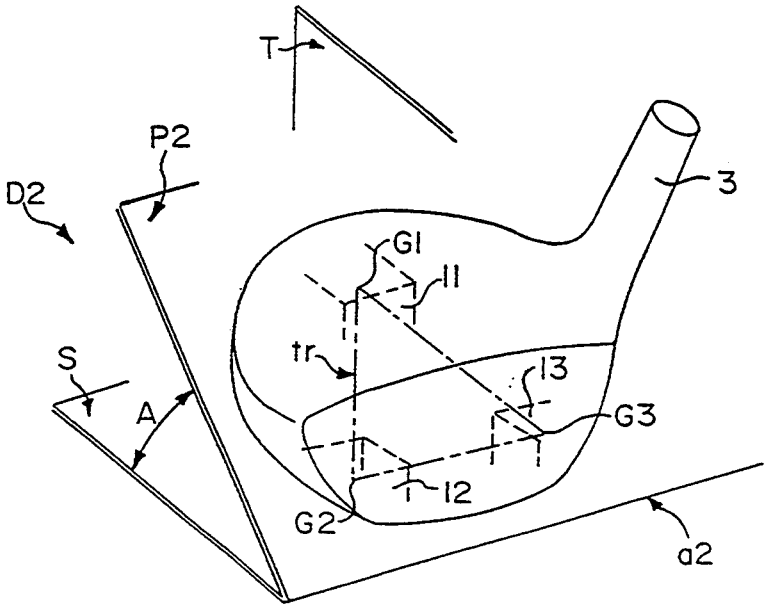
FIG. 18

GOLF CLUB HEAD

BACKGROUND OF THE INVENTION

1. Field of the Invention

The present invention is directed to a golf club and, particularly, to a golf club head. More specifically, the invention is related to an improvement of the head and, more specifically, to an improvement of a "wood" type of head.

2. Discussion of Background and Relevant Information

While playing golf, the player displaces a golf ball by propelling it with a golf club which is constituted by a shaft having a head at its lower end, whereas its upper end is equipped with a handle, often referred to as a grip.

To play golf, the player uses a certain number of clubs, all of which are different from one another and which are generally categorized into three classes, viz., woods, irons and putters.

Currently, clubs used by golfers when leaving the "tee" or starting zone to send the ball over relatively long distances are called "woods," and every manufacturer provides its products with a specific structure, while respecting a certain number of rules necessary for standardizing such clubs in competition. Thus, it is necessary to have a fixed dimension, inclination and mass, although a large number of other parameters are completely unregulated, and this is why there currently exists a very large diversity of products of very different designs.

In the game of golf, the precision of shots depends on a certain number of parameters, and especially human parameters. The forward hitting movement can be more or less precise and the position of the golf head during impact can be more or less precise with respect to the ball. Golfers are aware that the least lack of precision at the moment of striking the ball can have very disastrous consequences. Indeed, at the moment of impact, the point of impact of the ball on the hitting face of the club head must be perfectly aligned, joining the center of gravity of the ball and the center of gravity of the golf head. If this condition is not respected during impact, the golf head, under the effect of the impact, will pivot and the hitting surface will open or close and the path of the ball will not be the one desired. If the hitting surface opens substantially, the ball will veer to the right, and if the hitting surface closes, the ball will veer to the left. Current golf club heads are not very tolerant with regard to this point and it is necessary to hit the ball with much precision in order to produce a satisfactory shot.

Some manufacturers have already proposed solutions to increase the inertia of the head, but have not really solved the aforementioned problem in a satisfactory manner. That is, there is certainly room for improvements in club head design. One can cite as examples British Patent No. 440,379, Japanese Patent Publication No. 3-170175 and International Patent Application WO 88/01524. These documents disclose club heads comprising balancing weights or localized increases in the mass of the club head which only increase the inertia of the club in the vertical direction. The configurations disclosed only resolve problems related to rotations about a vertical axis and thus cause an imbalance in the behavior of the head.

SUMMARY OF THE INVENTION

An object of the present invention is to overcome disadvantages of known golf clubs, including the aforementioned disadvantage of known club heads.

Further, an object of the present invention is to propose a club head for a golf club which tolerates a relative lack of precision at the moment of impact, while enabling a correction of the path of the ball having been hit by an off-center shot. This result is obtained by a newly devised distribution of mass, providing the club with a better inertia both about a vertical axis as well as around a horizontal axis, the control of inertia thus occurring in all directions.

To this end, the present invention includes a golf club having a head, preferably of the wood type, including an orthogonal reference point at the center of gravity of the head, formed by three axes about which the inertia is maximum, whereby two of the three axes are located in a plane which is inclined with respect to the plane of the ground when the club head rests on the ground, and forms with the plane of the ground a dihedron having an internal angle comprised between 20 and 60 degrees and/or whereby the other of the three axes forms with the vertical shot plane an angle comprised between 20 and 60 degrees.

According to a particular embodiment of the invention, the club head includes at least three weights or localized increases in mass of the walls of the club head, each of the centers of gravity of the three weights forming a triangle. The weights are located substantially in a weight plane which is inclined with respect to the plane of the ground when the head rests on the ground.

According to preferred embodiment, the plane of the weights forms with the plane of the ground a dihedron having an internal angle of between 20 and 60 degrees.

According to one arrangement, the dihedron is open frontwardly, the inclined plane extending upwardly from the rear to the front.

According to another arrangement, the dihedron is open rearwardly, the inclined plane extending upwardly from the front to the rear.

According to a particular characteristic of one embodiment, the edge of the dihedron is perpendicular to the general plane of symmetry of the head.

According to a particular characteristic of another embodiment, the dihedron is inclined with respect to the general plane of symmetry of the head.

According to a particular characteristic of an embodiment of the invention, a central weight and two lateral weights are provided.

In one of the embodiments, the central weight is located close to the hitting surface, whereas the two lateral weights are located at the rear portion of the head.

In one variation, the central weight is located at the front upper portion of the head, the two lateral weights being located at the rear lower portion thereof, whereas in another variation, the central weight is located at the front lower portion of the head, the two lateral weights being located at the rear upper portion thereof.

In another embodiment, the central weight is located at the rear portion of the head, the two lateral weights being located close to the hitting surface.

In one variation, the central weight is located at the rear upper portion of the head, the two lateral weights being located at the front lower portion thereof, whereas in another variation, the central weight is located at the rear lower portion of the head, the two lateral weights being located at the front upper portion thereof.

According to a preferred embodiment, the head itself is formed by an assembly of metallic walls and the weights are constituted by a local increase in the thickness of the wall in the zone under consideration.

According to another embodiment, the weights are additional masses, independent of the remainder of the club head.

The material from which the walls of the club head is made preferably has a low density according to a particular embodiment. Such material can comprise a composite or a thermoplastic material. The weights of this embodiment can comprise independent steel masses.

BRIEF DESCRIPTION OF THE DRAWINGS

Other characteristics and advantages of the invention will become apparent from the description that follows with reference to the annexed drawings which are provided only as non-limiting examples. The figures of the invention only illustrate the lower portion of the club, the upper portion of the shaft comprising the grip being well known in the art.

FIGS. 2–6 illustrate, diagrammatically, perspective views of different embodiments of a head as per the present invention.

FIG. 2 is a view similar to FIG. 1 of a first embodiment of the invention.

FIGS. 3 and 4 are two views showing two other variations of the invention.

FIG. 5 is a view similar to FIG. 1 showing another head in accordance with the invention.

FIG. 6 is a view showing another embodiment of the invention in front perspective, the preceding drawings being in rear perspective.

FIGS. 7–10 illustrate the first variation of the FIG. 5 embodiment.

FIG. 7 is a front view in elevation.

FIG. 8 is a side view in elevation.

FIG. 9 is a top plan view.

FIG. 10 is a perspective view.

FIGS. 11–14 illustrate the second variation of the FIG. 5 embodiment.

FIG. 11 is a front view in elevation.

FIG. 12 is a side view in elevation.

FIG. 13 is a top plan view.

FIG. 14 is a perspective view.

FIGS. 15–22 illustrate two other variations in accordance with the embodiment of FIG. 6.

FIGS. 15–18 illustrate the first variation of the FIG. 6 embodiment.

FIG. 15 is a front view in elevation.

FIG. 16 is a lateral view in elevation.

FIG. 17 is a top plan view.

FIG. 18 is a perspective view.

FIGS. 19–22 illustrate the second variation of the FIG. 6 embodiment.

FIG. 19 is a front view in elevation.

FIG. 20 is a lateral view in elevation.

FIG. 21 is a top plan view.

FIG. 22 is a perspective view.

DETAILED DESCRIPTION OF THE PREFERRED EMBODIMENTS

Figure 1:
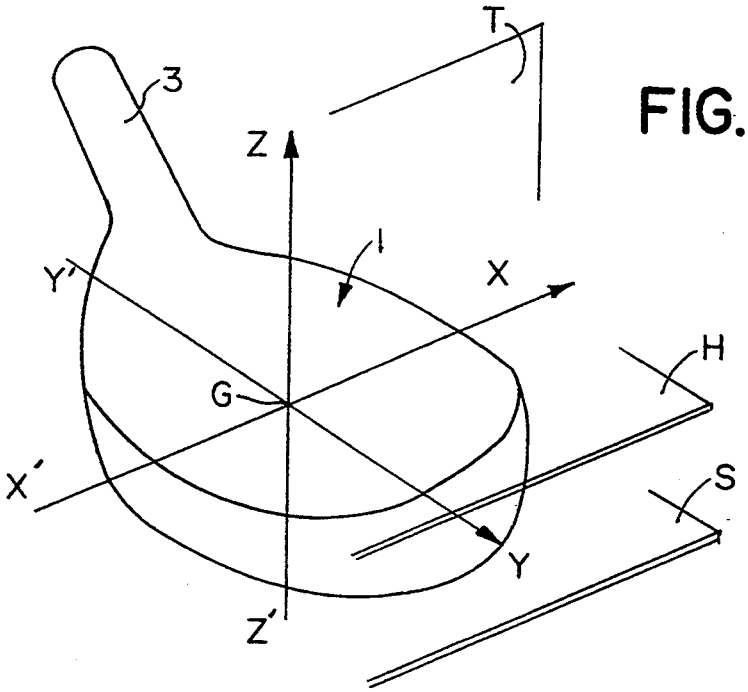
FIG. 1 illustrates a traditional head with its main axes of inertia.

As mentioned above, in the golf club head of the invention the orthogonal reference point at the center of gravity which is formed by the three axes about which the inertia is maximum and is such that the first two axes are located in a plane which is inclined with respect to the plane of the ground when the head rests on the ground, forming with the plane of the ground an acute angle dihedron between 20 and 60 degrees and/or wherein one of the two first axes forms, with the vertical plane of the shot, an angle between 20 and 60 degrees and, advantageously, 45 degrees.

According to a preferred arrangement, the head includes at least three weights whose centers of gravity forming a triangle are located substantially in a plane which is inclined with respect to the plane of the ground when the head rests on the ground. According to a complementary characteristic, the plane forms with the plane of the ground an acute angle dihedron between 20 and 60 degrees and, advantageously, 45 degrees.

According to one of the arrangements, the dihedron is open frontwardly, the inclined plane extending from the rear to the front and upwardly.

According to another arrangement, the dihedron is open rearwardly, the inclined plane extending thus from the front to the rear and upwardly.

According to a complementary characteristic, the edge of the dihedron is perpendicular to the general symmetrical plane of the head.

According to another characteristic, the head comprises a central weight and two lateral weights. In one of the embodiments, the central weight is located close to the hitting surface, whereas the two lateral weights are located at the rear portion of the head.

In one of the variations, the central weight is located at the front upper portion of the head, the two lateral weights being located at the rear lower portion thereof, whereas in another variation, the central weight is located at the front lower portion of the head, the two lateral weights are located at the rear upper portion thereof.

In another embodiment, the central weight is located at the rear portion of the head, the two lateral weights being located close to the hitting surface.

In one of the variations, the central weight is located at the rear upper portion of the head, the two lateral weights being located at the front lower portion thereof, whereas in another variation, the central weight is located at the rear lower portion of the head, the two lateral weights being located at the front upper portion thereof.

According to a preferred embodiment, the actual head is formed by an assembly of metallic walls, and the weights are constituted by a local increase in the thickness of the wall in the zone under consideration.

The heads illustrated in the drawings are in a position in which they rest on the ground. The present invention is particularly related to a head of the type known as "wood", although, as is well-known, such type of club can be made from materials other than wood.

The present invention will now be described with particular reference to the drawings in which exemplary embodiments of the invention are illustrated.

FIG. 1 is a perspective view of a traditional head, a view in which the three orthogonal axes are represented as X,X', Y,Y', Z,Z', about which he inertia is maximum, this reference passing through the center of gravity G, thus constituting the reference of the main axis of inertia. Thus, in a traditional head, the first of the axes X,X' is substantially parallel to the ground S and substantially in the vertical plane of the shot T, the second axis Y,Y' is in the horizontal plane H passing through the center of gravity G, the second axis being naturally perpendicular to the first axis X,X' and in the horizontal plane H containing it. The third of the axes Z,Z' is naturally perpendicular to the two others. This latter axis is therefore vertical and, due to this fact, it is perpendicular to the horizontal plane H and is contained in the vertical plane of the shot, or shot plane, T By "substantial", a variation of 1–10 degrees from vertical is contemplated.

Figure 2:
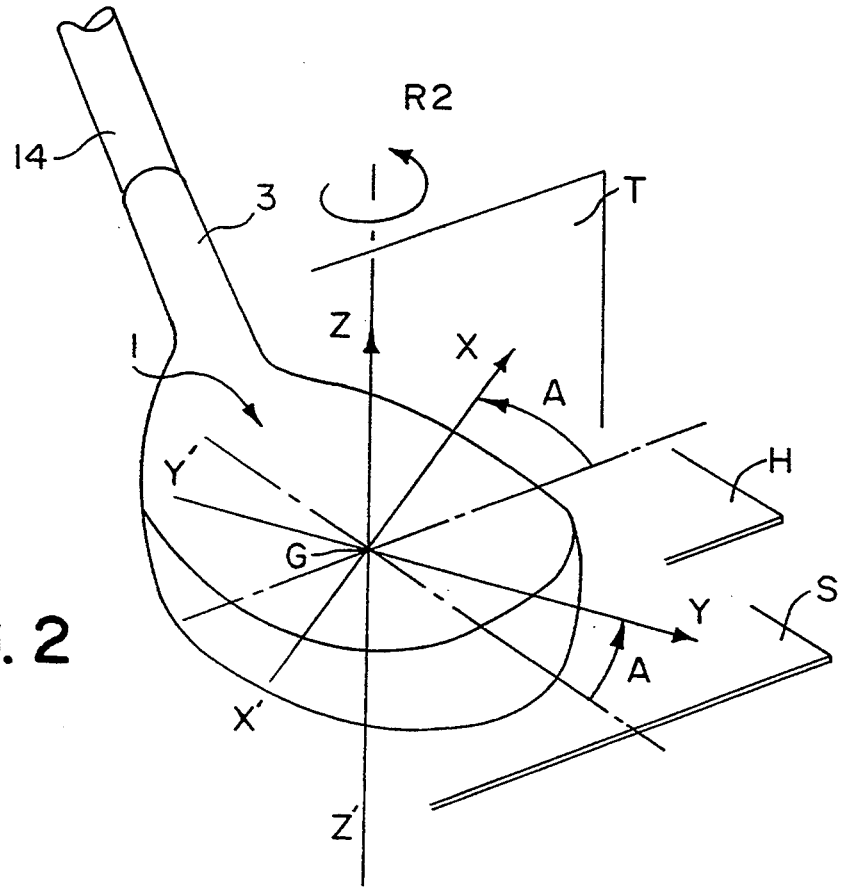

According to the first embodiment of the invention illustrated in FIG. 2, the head for a golf club whose orthogonal reference passes through the center of gravity G is formed by the three axes X,X', Y,Y', Z,Z' about which the inertia is maximum, and is such that the two first axes X,X', Y,Y' are located in the horizontal plane H and that one of the two first axes X,X' forms with the vertical plane of the shot T an angle A comprised between 20 and 60 degrees. The orthogonal reference X,X', Y,Y', Z,Z', with respect to the reference of FIG. 1, has been subject to a rotation R2 by an angle A about the axis Z,Z'. A shaft 14 can be attached to the club head in a manner known to those skilled in the art.

Figure 3:
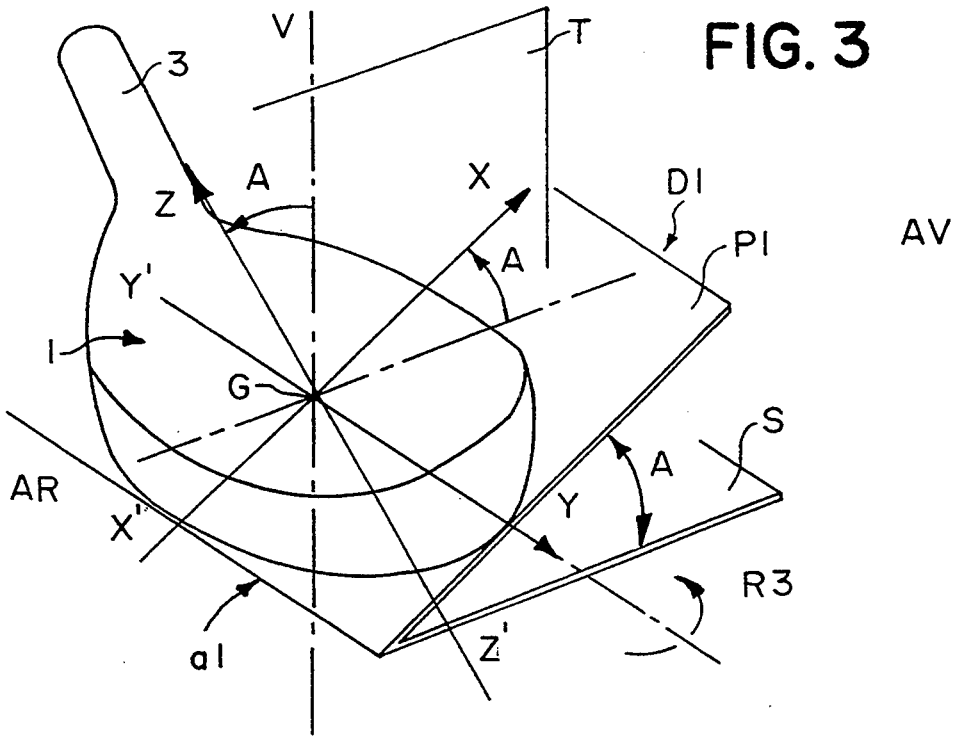

According to a second embodiment of the illustration of FIG. 3, the head for a golf club whose orthogonal reference passes through the center of gravity G is formed by three axes X,X', Y,Y', Z,Z' about which the inertia is maximum, is such that the first two axes X,X', Y,Y' are located in the plane P1 which is inclined with respect to the plane S of ground when the head rests on the ground, forming with the plane S of the ground a dihedron D1 open frontwardly AV, having an internal angle comprised between 20 and 60 degrees, and wherein the third axis Z,Z' forms with the vertical V, an angle A comprised between 20 and 60 degrees. The orthogonal reference X,X', Y,Y', Z,Z', with respect to the initial reference of FIG. 1, has been subject to a rearward rotation AR along R3 about the horizontal axis Y,Y'.

Figure 4:
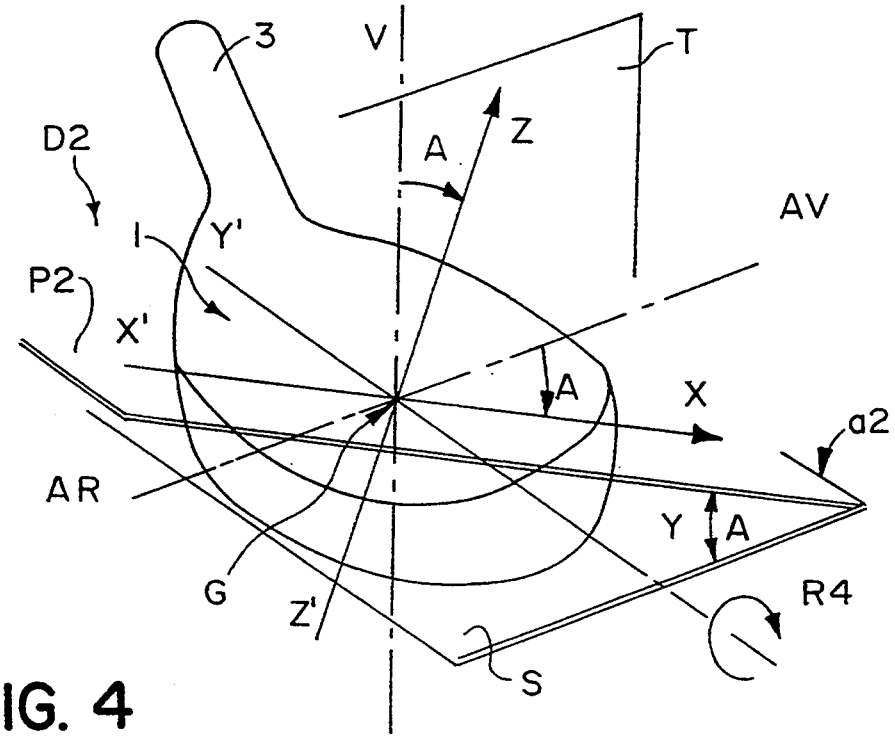
Figure 7:
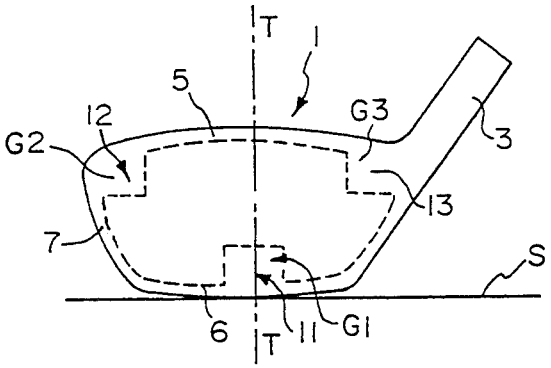
FIGS. 7–14 illustrate two variations in accordance with the embodiment of FIG. 5.
Figure 8:
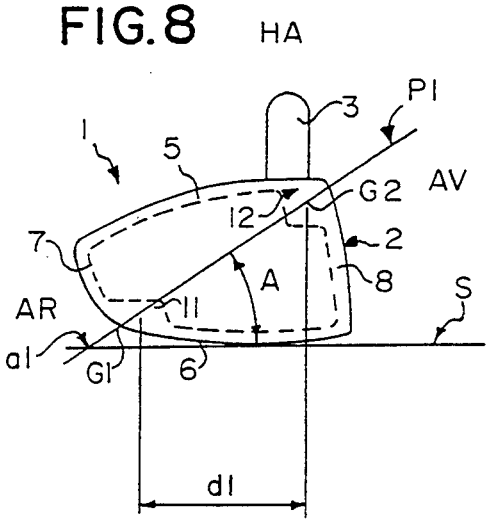
Figure 9:
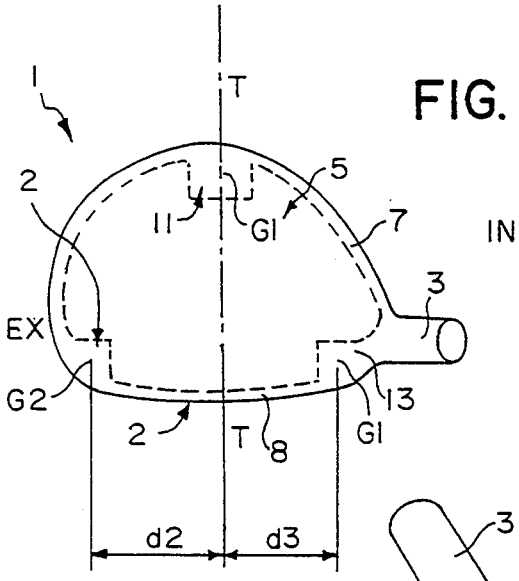
Figure 10:
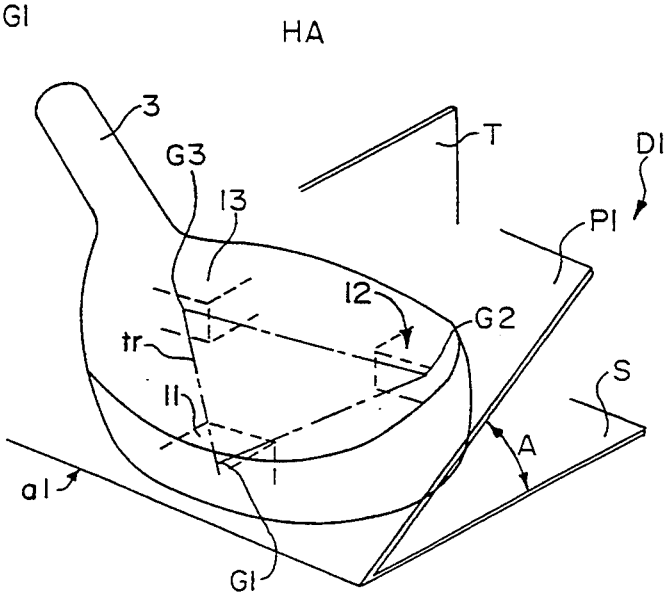
Figure 11:
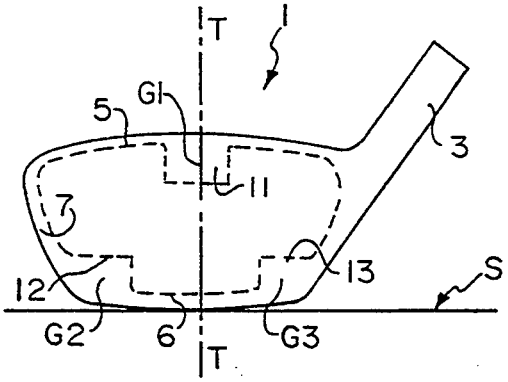
Figure 12:
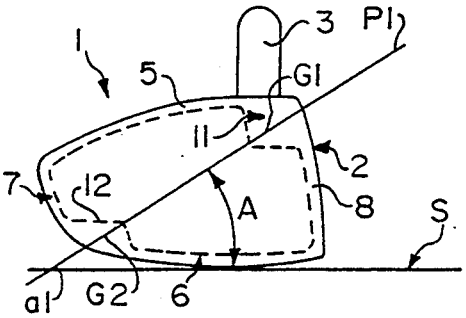
Figure 13:
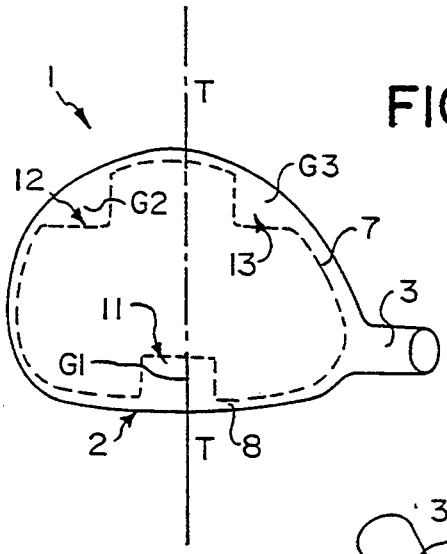
Figure 14:
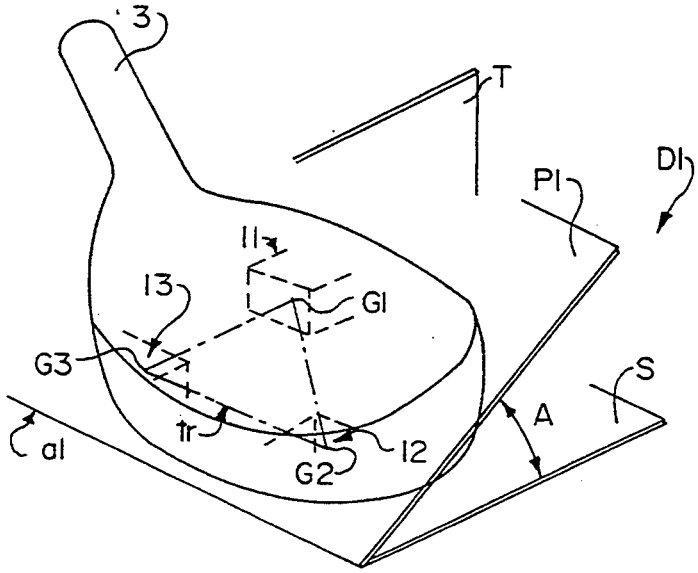
Figure 19:
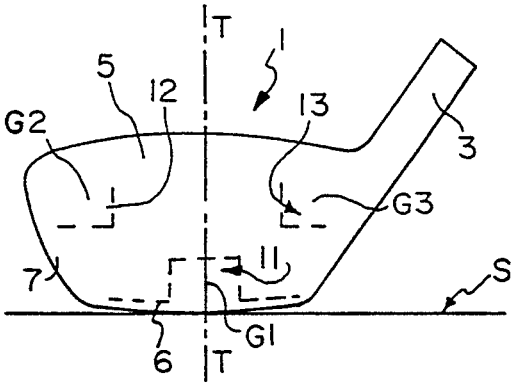
Figure 20:
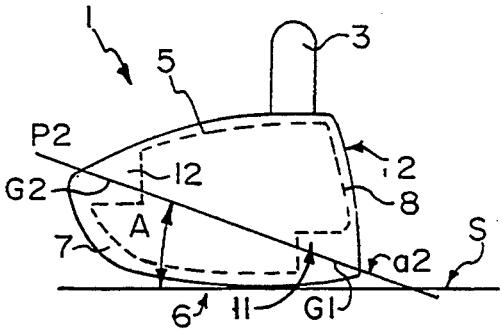
Figure 21:
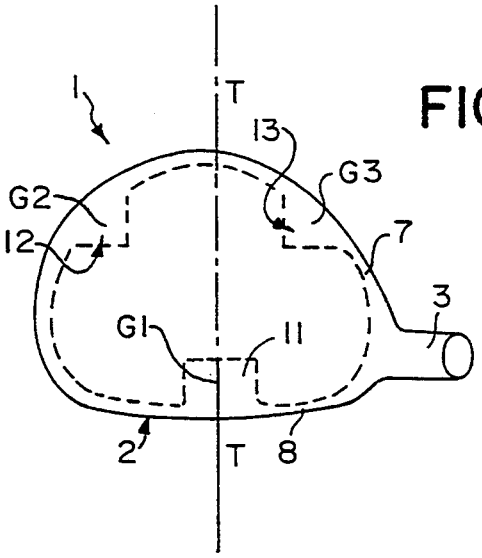
Figure 22:
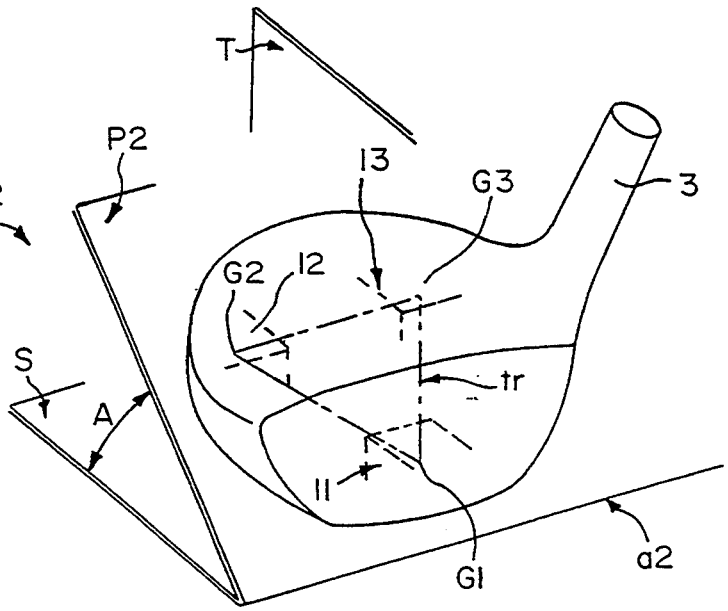

According to the third embodiment of the invention illustrated schematically in FIG. 4, the golf club head whose orthogonal reference passing through the center of gravity G is formed by the three axes X,X', Y,Y', Z,Z' about which the inertia are maximum is such that the first two axes X,X', Y,Y' are located in a plane PZ inclined with respect to the plane S of the ground when the head rests on the ground, forming with the plane S of the ground, a dihedron D2 open rearwardly AR, having an internal angle comprised between 20 and 60 degrees, and wherein the third angle Z,Z' located in the plane of the shot T, forms with the vertical V, an angle A comprised between 20 and 60 degrees. The orthogonal reference X,X', Y,Y', Z,Z', with respect to the initial reference of FIG. 1, has been subject to frontward rotation AV along R4 about the horizontal axis Y,Y'.

According to other embodiments of the invention illustrated in FIGS. 5 and 6, the golf club head, whose orthogonal reference passes through the center of gravity G is formed by three axes X,X', Y,Y', Z',Z', about which the inertia is maximum, is such that the two first axes X,X', Y,Y' are located in a plane P1,P2, respectively, inclined with respect to the plane S of the ground when the head rests on the ground, forming with the plane S of the ground, a dihedron D1,D2, respectively, having an internal angle comprised between 20 and 60 degrees, and that one of the first two axes X,X' forms with the vertical plane of the shot T an angle A comprised between 20 and 60 degrees. The plane can be inclined frontwardly or rearwardly to form with the horizontal plane S of the ground, a dihedron D1 open frontwardly FIG. 5 or a dihedron D2, open rearwardly FIG. 6. According to the two variations illustrated in FIGS. 5 and 6, the first axis X,X' forms with a plane of the shot T an angle A comprised between 20 and 60 degrees. Further, the third axis Z,Z' contained in the plane of the shot T, forms with the vertical axis V,V', an angle A' comprised between 20 and 60 degrees.

The club head as per the invention is of the "wood" type and comprises, as illustrated in FIGS. 1–9, a shell 1 comprising a hitting surface 2 which is extended laterally and upwardly by a neck 3 adapted to receive the shaft of the club. The shell 1 itself is formed by a metallic or a plastic envelope or shell, or can be made of a composite material, and is constituted by an assembly of walls, an upper wall 5, a lower wall 6, a peripheral wall 7 and a front wall 8. These different walls furthermore form a closed hollow body, constituting an internal cavity 9 advantageously filled with foam 10, such as for example a polyurethane foam. The head comprises a plane of the shot T which, during impact with the ball, is perpendicular to the plane S of the ground substantially constituting its generally symmetrical plane. Naturally, the shell can also be formed by a shell which is other than metallic and, for example, can be made of plastic or a composite material.

According to the embodiments of the invention, the head comprises at least three peripheral "weights" 11,12,13. Advantageously, these weights are constituted by a local increase in the thickness of the wall of the zone under consideration, thus constituting projections extending within cavity 9, but it can also be otherwise as will be explained hereinafter.

According to a characteristic arrangement of the invention which is common to all embodiments, the weights are obtained by a central weight 11 having a center of gravity. and two lateral weights 12 and 13 having respective centers of gravity G2,G3. According to the invention, the three centers of gravity G1,G2,G3 respectively of the three weights 11,12,13 are located in a plane, i.e., a weight plane, P1 or P2 which is inclined with respect to the ground, forming with the plane S of the ground, a dihedron D1 or D2 open frontwardly AV or rearwardly AR. Further, the three centers of gravity G1,G2,G3 form, in the inclined plane, a triangle tr.

Further, in accordance with complementary characteristics of the invention, the inner angle A of the dihedron is comprised between 20 and 60 degrees, whereas its edge a1 is advantageously perpendicular to the plane of the shot T.

The first embodiment generally shown in FIG. 5 and particularly illustrated in FIGS. 7–10, is such that the plane P1 extends from the rear AR towards the front AV and upwardly HA. The central weight 11 is a central rear weight located in the rear central lower zone of cavity 9, whereas the two lateral weights 12,13 are located in the upper front portion of the cavity 9. The first lateral weight 12 is located at the external side EX at a distance d2 from plane T, whereas the second weight 13 is located at the internal side IN at a distance d3. As an example, for a "wood" type head made of a plastic material, having a mass of 140 grams, the mass M1 of the central weight 11 can be 38 grams, whereas the mass of the lateral weights 12,13 can each be 15 grams, the remainder of the mass of the head being obtained by the filling material of the hollow body. Further, the distance d1 can be 32 millimeters, whereas the distance d3 can be 28 millimeters, and the distance d1 can be 44 millimeters. The mass M1 of the central weight is advantageously greater than the mass M2 or the mass M3. As an example, the mass M2 can be equal to the mass M3 and in this case, the distance d2 is less than the distance d3 but the mass M3 can be different and, for example, greater than the mass M2 and in this case, distance d2 is equal to distance d3.

FIGS. 11–14 illustrate, in views similar to the preceding figures, a second embodiment as per FIG. 5, and according to which the central weight is located at the front of the head, whereas the two lateral weights are located at the rear thereof. Thus, the front central weight 11 is located in the plane of the shot T behind the upper portion of the front face 2, whereas the first lateral weight 12 is located in the external lateral rear lower portion of the head, the second lateral weight 13 is located in the lower internal rear lateral zone thereof. The three centers of gravity G1,G2,G3 are naturally located in a plane P1 inclined with respect to the ground. The plane P1 forms as per the invention, with a plane S of the ground, a dihedron open frontwardly AV and the inner angle A thus formed being comprised between 20 and 60 degrees.

FIGS. 15 to 22 illustrate other embodiments in accordance with the arrangement of FIG. 6, according to which the centers of gravity G1,G2,G3 of the three weights 11,12,13 are located in an inclined plane P2 forming with the plane S of the ground a dihedron D2 open rearwardly AR. The plane P2 extends therefore from the front AV to the rear AR and upwardly. According to these variations, the inner angle A of the dihedron D2 is comprised between 20 and 60 degrees, and its edge a2 is advantageously perpendicular to the plane of the shot T.

According to the embodiment illustrated in FIGS. 15–18 the central weight 11 is a rear central weight located in an upper rear central zone of the cavity 9, whereas the two lateral weights 12,13 are located at the lower front portion of said cavity 9. The first lateral weight 12 is located at the external side EX of the plane T, whereas the second weight 13 is located at the internal side IN. Advantageously, the two lateral weights 12 and 13 are located symmetrically with respect to the plane of the shot T but it could also be otherwise.

FIGS. 19 to 22 represent a variation of the preceding embodiment and for which the plane P2 of the three centers of gravity of the masses 11,12,13 is inclined frontwardly to form with the plane S of the ground, a dihedron D2 open rearwardly. The plane P2 forms with a plane S an angle A comprised between 20 and 60 degrees, as mentioned previously. However, the central weight 11 is located at the center, at the front lower portion of cavity 9 whereas the two lateral weights are located at the rear upper portion of the cavity.

Figure 23:
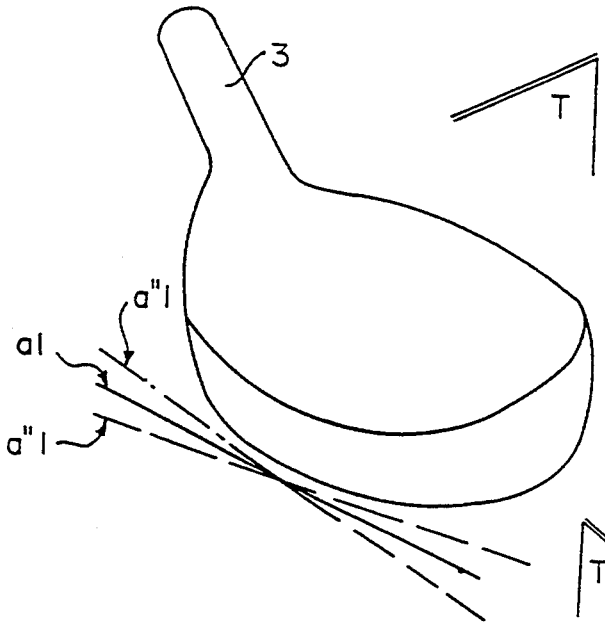
FIGS. 23, 24 and 25 are perspective views showing further embodiments of the invention.
Figure 24:
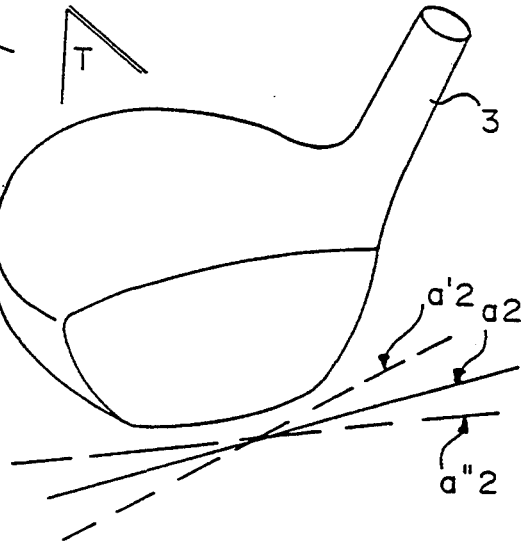

Naturally, edge a1 or a2 of the dihedron D1 or of the dihedron D2 is, according to a preferred embodiment, perpendicular to the plane T but it can also be otherwise. Thus, the edges of the dihedron can be slightly inclined with respect to the plane T as is represented in dotted and dashed lines in FIGS. 23 and 24, by the references a'1, a''1, a'2, a''2.

Figure 25:
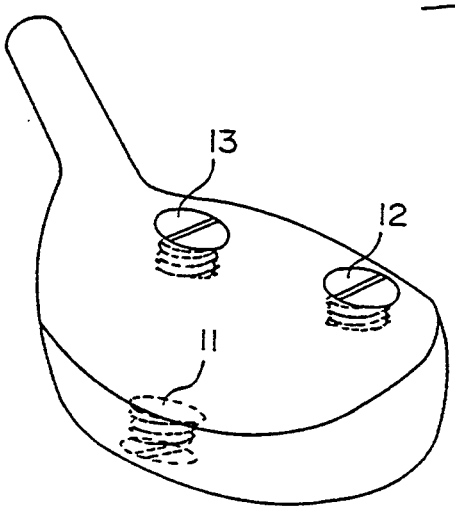
Figure 26:
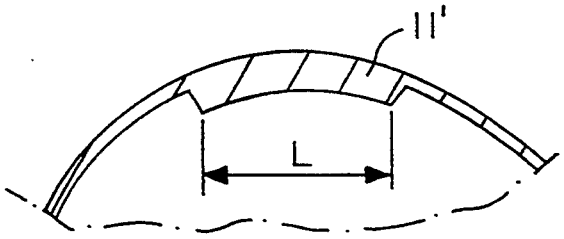
FIGS. 26 and 27 are partial sectional views illustrating different embodiments of the weightings.
Figure 27:
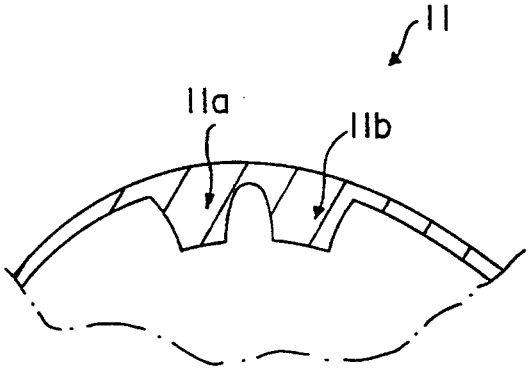

It is understood that the head in accordance with the invention can be of the type in which the weights are separate from the head and are attached, as represented in FIG. 25. Further, the weights can be obtained by a local increase in the density of the material constituting the walls of the head. The weights can be constituted, as has already been mentioned previously, by a local increase in thickness of the walls of the envelope or shell of the club head, and FIGS. 26 and 27 illustrate variations thereof. FIG. 26 is a variation according to which weight 11' is obtained by an increase in thickness extending along a length L which can be more or less long. FIG. 27 illustrates another variation according to which weight 11 is constituted by two semi-weights 11A,11B.

The instant application is based upon French patent application No. 92.07381 of Jun. 12, 1992, the disclosure of which is hereby expressly incorporated by reference thereto, and the priority of which is hereby claimed.

The invention is not limited to the embodiments described and represented as examples hereinabove, but also comprises all technical equivalents and combinations thereof that fall within the scope of the following claims. Further, although angle ranges are given in many of the various embodiments of the invention, other ranges subsumed within the ranges mentioned are also contemplated to be within the scope of the invention.

What is claimed is:

1. A golf club head for a wood type golf club, said club head comprising:

a center of gravity;

an orthogonal reference point at the center of gravity, formed by three axes about which the inertia is maximum, wherein two of the three axes are located in a plane which is inclined with respect to the plane of the ground when the club head rests on the ground, the two axes forming with the plane of the ground, a dihedron having an internal angle comprised between 20 and 60 degrees; said club head further including weight means for weighting the club head and for maximizing the inertia.

2. A golf club head in accordance with claim 1, further comprising a shot plane, and wherein:

a third of the three axes forms, with the vertical plane of the shot, an angle comprised between 20 and 60 degrees.

3. A golf club head in accordance with claim 2, wherein:

the club head comprises a general plane of symmetry; and the dihedron comprises an edge, said edge being perpendicular to the general plane of symmetry of the club head.

4. A golf club head in accordance with claim 2, wherein:

the club head comprises a general plane of symmetry; and the dihedron comprises an edge, said edge being inclined to the general plane of symmetry of the club head.

5. A golf club head in accordance with claim 2, further comprising:

an assembly of metallic walls constituting a hollow body.

6. A golf club head in accordance with claim 2, wherein:

the golf club head comprises a hollow body comprised of a plurality of walls; and each of the weights is constituted by a local increase in the thickness of a respective wall.

7. A golf club head in accordance with claim 2, wherein:

said weight means comprises at least three weights, each of the three weights having a center of gravity, the three centers of gravity of the three weights forming a triangle located substantially in a weight plane which is inclined with respect to the plane of the ground when the head rests on the ground.

8. A golf club head in accordance with claim 7, wherein:

said weights comprise a central weight and two lateral weights.

9. A golf club head in accordance with claim 8, wherein:

the golf club head further comprises a front portion, a rear portion and a hitting surface;

the central weight is located at the front portion and close to the hitting surface; and the two lateral weights are located at the rear portion.

10. A golf club head in accordance with claim 9, wherein:

the golf club head further comprises a front upper portion and a rear lower portion;

the central weight is located at the front upper portion; and the two lateral weights are located at the rear lower portion.

11. A golf club head in accordance with claim 9, wherein:

the golf club head further comprises a front lower portion and a rear upper portion;

the central weight is located at the front lower portion; and the two lateral weights are located at the rear upper portion.

12. A golf club head in accordance with claim 8, wherein:

the golf club head further comprises a front portion, a rear portion and a hitting surface;

the central weight is located at the rear portion; and the two lateral weights are located at the front portion and close to the hitting surface.

13. A golf club head in accordance with claim 8, wherein:

the golf club head further comprises a front portion, a rear portion and a hitting surface;

the two lateral weights are located at the front portion and close to the hitting surface; and the central weight is located at the rear portion.

14. A golf club head in accordance with claim 24, wherein:

the golf club head further comprises an upper rear portion and a lower front portion;

the central weight is located at the upper rear portion; and the two lateral weights are located at the lower front portion.

15. A golf club head in accordance with claim 13, wherein:

the golf club head further comprises a rear lower portion and a front upper portion;

the central weight is located at the rear lower portion; and the two lateral weights are located at the front upper portion.

16. A golf club head in accordance with claim 7, wherein:

the weights comprise respective masses independent of the remainder of the club head.

17. A golf club head in accordance with claim 1, wherein:

said weight means comprises at least three weights, each of the three weights having a center of gravity, the three centers of gravity of the three weights forming a triangle located substantially in a weight plane which is inclined with respect to the plane of the ground when the head rests on the ground.

18. A golf club head in accordance with claim 17, wherein:

the weight plane forms, with the plane of the ground, a dihedron having an internal angle comprised between 20 and 60 degrees.

19. A golf club head in accordance with claim 18, further comprising:

a front and a rear; and wherein the dihedron is open frontwardly, the inclined weight plane extending from the rear to the front and upwardly.

20. A golf club head in accordance with claim 18, further comprising:

a front and a rear; and wherein the dihedron is open rearwardly, the inclined weight plane extending from the front to the rear and upwardly.

21. A golf club head in accordance with claim 17, further comprising:

a front and a rear; and wherein the dihedron is open frontwardly, the inclined weight plane extending from the front to the rear and upwardly.

22. A golf club head in accordance with claim 17, wherein:

said weights comprise a central weight and two lateral weights.

23. A golf club head in accordance with claim 22, wherein:

the golf club head further comprises a front portion, a rear portion and a hitting surface;

the central weight is located at the rear portion; and the two lateral weights are located at the front portion and close to the hitting surface.

24. A golf club head in accordance with claim 22, wherein:

the golf club head further comprises a front portion, a rear portion and a hitting surface;

the two lateral weights are located at the front portion and close to the hitting surface; and the central weight is located at the rear portion.

25. A golf club head in accordance with claim 24, wherein:

the golf club head further comprises an upper rear portion and a lower front portion;

the central weight is located at the upper rear portion; and the two lateral weights are located at the lower front portion.

26. A golf club head in accordance with claim 24, wherein:

the golf club head further comprises a rear lower portion and a front upper portion;

the central weight is located at the rear lower portion; and the two lateral weights are located at the front upper portion.

27. A golf club head in accordance with claim 22, wherein:

the golf club head further comprises a front portion, a rear portion and a hitting surface;

the central weight is located at the front portion and close to the hitting surface; and the two lateral weights are located at the rear portion.

28. A golf club head in accordance with claim 27, wherein:

the golf club head further comprises a front lower portion and a rear upper portion;

the central weight is located at the front lower portion; and the two lateral weights are located at the rear upper portion.

29. A golf club head in accordance with claim 27, wherein:

the golf club head further comprises a front upper portion and a rear lower portion;

the central weight is located at the front upper portion; and the two lateral weights are located at the rear lower portion.

30. A golf club head in accordance with claim 17, wherein:

the weights comprise respective masses independent of the remainder of the club head.

31. A golf club head in accordance with claim 1, wherein:

the club head comprises a general plane of symmetry; and the dihedron comprises an edge, said edge being perpendicular to the general plane of symmetry of the club head.

32. A golf club head in accordance with claim 1, wherein:

the club head comprises a general plane of symmetry; and the dihedron comprises an edge, said edge being inclined to the general plane of symmetry of the club head.

33. A golf club head in accordance with claim 1, further comprising:

an assembly of metallic walls constituting a hollow body.

34. A golf club head in accordance with claim 1, wherein:

the golf club head comprises a hollow body comprised of a plurality of walls; and each of the weights is constituted by a local increase in the thickness of a respective wall.

35. A golf club head in accordance with claim 1, wherein:

the golf club head comprises an assembly of walls of a low density material.

36. A golf club head in accordance with claim 35, wherein:

the low density material of which the walls are comprised is a composite material.

37. A golf club head in accordance with claim 35, wherein:

the low density material of which the walls are comprised is a thermoplastic material.

38. A golf club head in accordance with claim 35, wherein:

the weights are constituted by steel having a greater density that the low density material.

39. A golf club head in accordance with claim 1 in combination with a shaft connected to said golf club head to comprise a golf club.

40. A golf club head for a wood type golf club, said club head comprising:

a center of gravity;

a vertical shot plane;

an orthogonal reference point at the center of gravity, formed by three axes about which the inertia is maximum, wherein one of the three axes forms with the vertical shot plane an angle comprised between 20 and 60 degrees; said club head further including weight means for weighting the club head and for maximizing the inertia.

41. A golf club head in accordance with claim 40 in combination with a shaft connected to said golf club head to comprise a golf club.

42. A golf club head comprising:

a center of gravity;

a vertical shot plane;

an orthogonal reference point at the center of gravity, the reference point being formed by three axes about which the inertia is maximum, and wherein the three axes are situated in at least one of the following relationships: (1) two of the three axes are located in a plane which is inclined with respect to the plane of the ground when the club head rests on the ground, the two axes forming with the plane of the ground, a dihedron having an internal angle comprised between 20 and 60 degrees; and (2) one of the three axes forms with the vertical shot plane an angle comprised between 20 and 60 degrees; said club head further including weight means for weighting the club head and for maximizing the inertia.

43. A golf club head in accordance with claim 42 in combination with a shaft connected to said golf club head to comprise a golf club.

44. A golf club head comprising:

a body having a predeterminate distribution of mass, including a center of gravity (G), said body further comprising:

a front portion, said front portion having a hitting surface (2); and a shot plane (T) extending, during impact with a golf ball during a shot, generally symmetrically through said body and extending frontwardly through said hitting surface (2) and generally perpendicularly with respect to said hitting surface (2) and with respect to a ground plane (S);

an orthogonal reference point at the center of gravity (G), the reference point being formed by three orthogonal axes (X–X′, Y–Y′, Z–Z′) about each of said axes the inertia of the body is maximum, and said three axes being situated in at least one of the following relationships:

(1) two of the three axes (X–X′, Y–Y′, Z–Z′) being located in a plane (P1 or P2) which is inclined with respect to the ground plane (S), the two axes forming, with the plane of the ground, a dihedron having an internal angle comprised between 20 and 60 degrees; and (2) one of the three axes (X–X′, Y–Y′, Z–Z′) forming, with said shot plane (T), an angle comprised between 20 and 60 degrees.

* * * * *